US009068386B2

(12) United States Patent
Ishii et al.

(10) Patent No.: US 9,068,386 B2
(45) Date of Patent: Jun. 30, 2015

(54) STOWABLE FOLDING DOOR DEVICE

(71) Applicant: SUGATSUNE KOGYO CO., LTD., Tokyo (JP)

(72) Inventors: Hiroyuki Ishii, Tokyo (JP); Shinichi Ajiki, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 14/374,920

(22) PCT Filed: Dec. 7, 2012

(86) PCT No.: PCT/JP2012/081784

§ 371 (c)(1),
(2) Date: Jul. 28, 2014

(87) PCT Pub. No.: WO2013/114730

PCT Pub. Date: Aug. 8, 2013

(65) Prior Publication Data

US 2015/0008811 A1 Jan. 8, 2015

(30) Foreign Application Priority Data

Jan. 31, 2012 (JP) ..... 2012-018907

(51) Int. Cl.
*E05D 15/26* (2006.01)
*E05D 15/00* (2006.01)
(Continued)

(52) U.S. Cl.
CPC ..... *E05D 15/264* (2013.01); *E05D 15/58* (2013.01); *E05Y 2900/212* (2013.01); *E05Y 2201/708* (2013.01); *E06B 3/482* (2013.01); *E06B 3/5045* (2013.01)

(58) Field of Classification Search
CPC ..... E05Y 2900/132; E05Y 2900/212; E05Y 2900/20; E05D 15/58; E05D 15/264; E05B 3/5045
USPC ..... 160/193, 206, 207, 208, 213, 203, 199; 312/322, 319.2, 326, 329, 350, 323; 49/360, 254, 257, 272, 405
See application file for complete search history.

(56) References Cited

U.S. PATENT DOCUMENTS 1,412,871 A * 4/1922 Johnson ..... 160/189
1,841,185 A * 1/1932 Johnson ..... 160/193
(Continued)

FOREIGN PATENT DOCUMENTS

DE 4308196 * 10/1993
DE 19709461 * 3/1997
(Continued)

OTHER PUBLICATIONS

Description of DE 4308196, Machine Translation retrieved from www.espacenet.com, Nov. 1, 2014.*
(Continued)

*Primary Examiner* — Daniel J Troy
*Assistant Examiner* — Kimberley S Wright
(74) *Attorney, Agent, or Firm* — Young & Thompson

(57) ABSTRACT

A stowable folding door device includes a slider to move the folded door in a depth direction of an article of furniture, a hook supported by the slider so as to rotate about a first rotation shaft and to engage with an engaging section provided on the article of furniture, and a lever supported by the hook to rotate about a second rotation shaft. Upon folding up the foldable door, the lever rotates in a first direction about the first rotation shaft together with the hook while contacting the rear surface of the foldable door, and the engagement between the hook and the engaging section is released. When the foldable door closes an opening of the article of furniture, the lever rotates relative to the hook in the direction opposite the first direction about the second rotation shaft while contacting the rear surface of the foldable door.

4 Claims, 11 Drawing Sheets

(51) Int. Cl.

| | |
|---|---|
| ***E05D 15/58*** | (2006.01) |
| ***A47B 88/00*** | (2006.01) |
| ***E06B 3/48*** | (2006.01) |
| ***E06B 3/50*** | (2006.01) |

(56) References Cited

U.S. PATENT DOCUMENTS

| | | | | |
|---|---|---|---|---|
| 1,873,247 | A * | 8/1932 | Abbott et al. | 109/70 |
| 2,155,116 | A * | 4/1939 | Cox | 160/193 |
| 3,024,838 | A * | 3/1962 | Egleston et al. | 160/193 |
| 3,075,819 | A * | 1/1963 | Liegeon et al. | 312/271 |
| 3,270,801 | A * | 9/1966 | Richter et al. | 160/213 |
| 3,275,064 | A * | 9/1966 | Niels | 160/206 |
| 4,945,972 | A | 8/1990 | Takeuchi | |
| 5,072,768 | A * | 12/1991 | Bonetti et al. | 160/199 |
| 5,131,449 | A | 7/1992 | Winn et al. | |
| 7,478,892 | B2 * | 1/2009 | Punzel et al. | 312/322 |
| 8,303,056 | B2 * | 11/2012 | Giorgi | 312/322 |
| 8,671,633 | B2 * | 3/2014 | Haab et al. | 52/243.1 |
| 2010/0117500 | A1 * | 5/2010 | Giorgi | 312/319.1 |
| 2010/0282418 | A1 * | 11/2010 | Lucas | 160/54 |
| 2013/0145705 | A1 * | 6/2013 | Haab et al. | 52/235 |
| 2013/0213586 | A1 * | 8/2013 | Lucas | 160/54 |
| 2013/0228292 | A1 * | 9/2013 | Lucas | 160/195 |
| 2013/0292067 | A1 * | 11/2013 | Lucas | 160/213 |

FOREIGN PATENT DOCUMENTS

| | | |
|---|---|---|
| JP | 02-66279 | 3/1990 |
| JP | 06-212854 | 8/1994 |

OTHER PUBLICATIONS

International Search Report PCT/JP2012/081784 dated Feb. 26, 2013.

* cited by examiner

A–A Cross Section

B–B Cross Section

C–C Cross Section

D–D Cross Section

STOWABLE FOLDING DOOR DEVICE

TECHNICAL FIELD

The present invention relates to a stowable folding door device that can guide opening and closing movements of a foldable door and stow the folded door in an article of furniture or a partition member in a depth direction of the article of furniture or the partition member.

BACKGROUND ART

A foldable door is a door that can fold by means of hinges, and is suitable for opening and closing an opening of an article of furniture (e.g., cupboard or closet) or a partition member (e.g., partition member between rooms in a building).

If the folded door protrudes from the front face of the article of furniture or from the front face of the partition member, the folded door becomes an obstacle. In recent years, therefore, a stowable folding door device that can stow the folded door inward of the article of furniture or the partition member is proposed (see Patent Literature 1).

As shown in FIG. 11, this stowable folding door device includes a slider 4 that causes the foldable door to move in the depth direction of the article of furniture. The foldable door 2 has two doors (i.e., doors 1 and 2), the doors 1 and 2 are rotatably connected to each other by hinges 3. One end of the door 1 is rotatably supported by the slider 4. One end of the door 2 is rotatably supported by a roller traveling element 6 that travels along a guide rail 5. The guide rail 5 bends in an L shape, and includes a first guide rail 5*a* that is parallel to the front face of the article of furniture, and a second guide rail 5*b* that extends in the depth direction of the article of furniture.

This stowable folding door device is equipped with a lock mechanism to prevent the slider 4 from moving before the foldable door completely closes. This is because if the slider 4 moves prior to the complete folding of the foldable door, the folded door cannot be stowed in the article of furniture. The lock mechanism includes a hook 7 that is supported by the slider 4 such that the hook can rotate about a predetermined rotation shaft. As illustrated in FIG. 11(*a*), the hook 7 engages with a recess (not shown) of the article of furniture to prevent the slider 4 from moving in the depth direction of the article of furniture prior to the complete folding of the foldable door. As illustrated in FIG. 11(*b*), as the foldable door is completely folded, a working plate (not shown) provided on the roller traveling element 6 abuts on the hook 7, and the hook 7 rotates to disengage the hook 7 from the recess of the article of furniture. This allows the slider 4 to move in the depth direction of the article of furniture.

LISTING OF REFERENCES

Patent Literatures

PATENT LITERATURE 1: Japanese Patent Application Laid-Open (Kokai) Publication No. 6-212854

SUMMARY OF THE INVENTION

Problems to be Solved by the Invention

Because the conventional stowable folding door device has the working plate on the roller traveling element 6 that travels along the upper portion of the opening of the article of furniture, there are some problems; the stowing space of the article of furniture is reduced by the moving space of the working plate, and the appearance becomes bad.

If no working plate is provided on the roller traveling element 6, and the lock of the slider 4 can be released by means of the rear face of the foldable door, then the above-described problems would be overcome. However, how to release the lock of the slider 4 by means of the rear face of the foldable door is the question.

As such, an object of the present invention is to provide a stowable folding door device that can release the lock of the slider by means of a rear face of the foldable door.

Solution to Overcome the Problems

In order to overcome the above-described problems, the invention provides a stowable folding door device configured to guide the opening and closing movements of a foldable door and cause the folded door to move in a depth direction of an article of furniture or a partition member. The stowable folding door device includes a slider configured to move the folded door in the depth direction of the article of furniture or the partition member, a hook rotatably supported by the slider such that the hook can rotate about a first rotation shaft and engage with an engaging element provided at the article of furniture or the partition member, and a lever supported by the hook such that the lever can rotate about a second rotation shaft. When the foldable door is folded, the lever rotates about the first rotation shaft in a first direction together with the hook while the lever being in contact with a rear face of the foldable door. This releases the engagement between the hook and the engaging element, and the slider can move in the depth direction of the article of furniture or the partition member. When the foldable door closes the opening of the article of furniture or the partition member, the lever rotates relative to the hook about the second rotation shaft in a direction opposite the first direction while the lever being in contact with the rear face of the foldable door.

Advantages of the Invention

According to the present invention, it is possible to release the lock of the slider by using the rear face of the foldable door when folding the foldable door. In addition, when the foldable door closes the opening of the article of furniture or the partition member, the lever escapes in a manner not to obstruct the moving route of the foldable door. Accordingly, even if the lever is provided to interfere with the moving route of the foldable door, the foldable door can close the opening of the article of furniture or the partition member.

MODE FOR CARRYING OUT THE INVENTION

Figure 1:
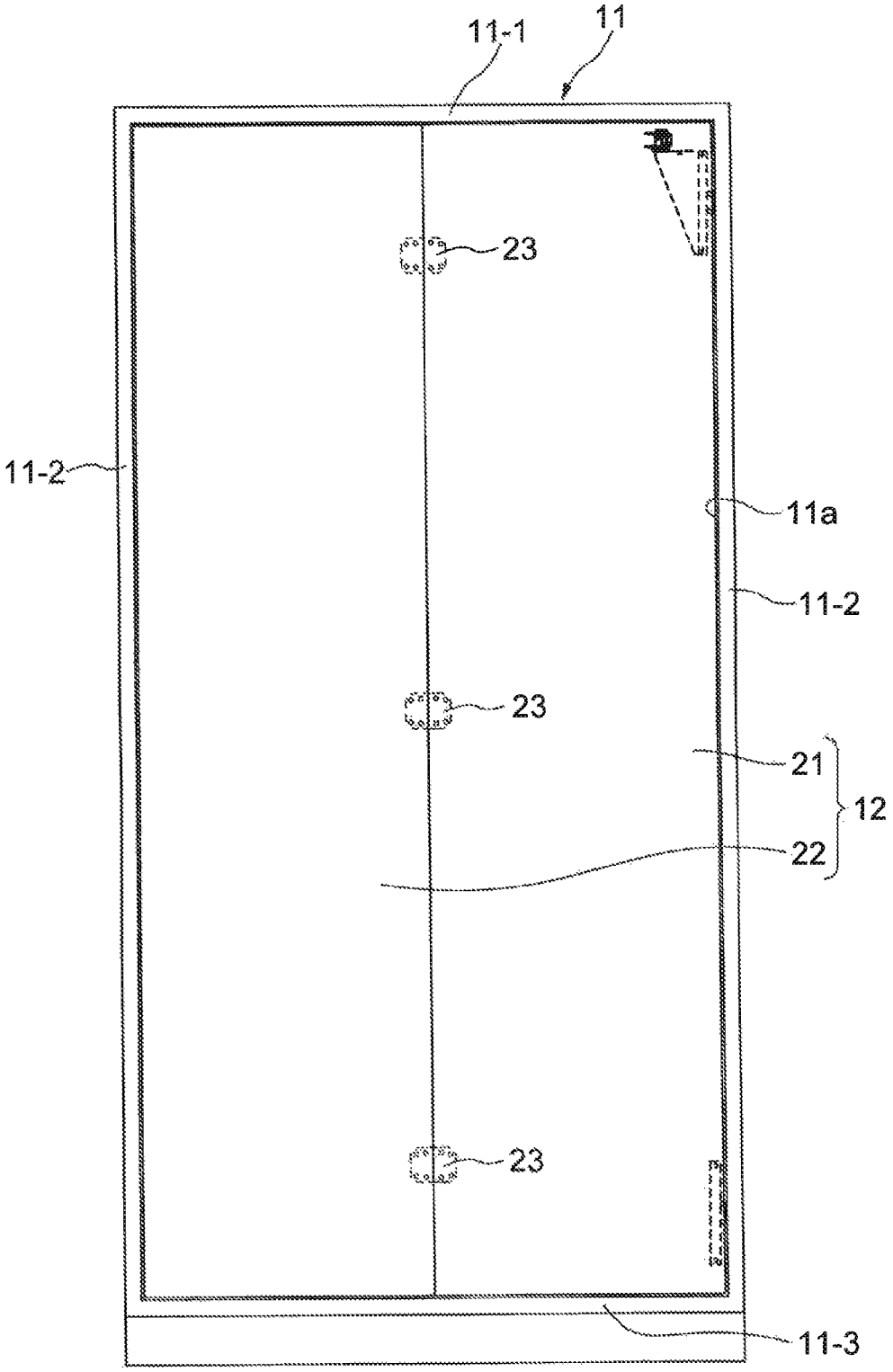
FIG. 1 is a front view of an article of furniture, in which a stowable folding door device according to one embodiment of the present invention is incorporated.
Figure 2:
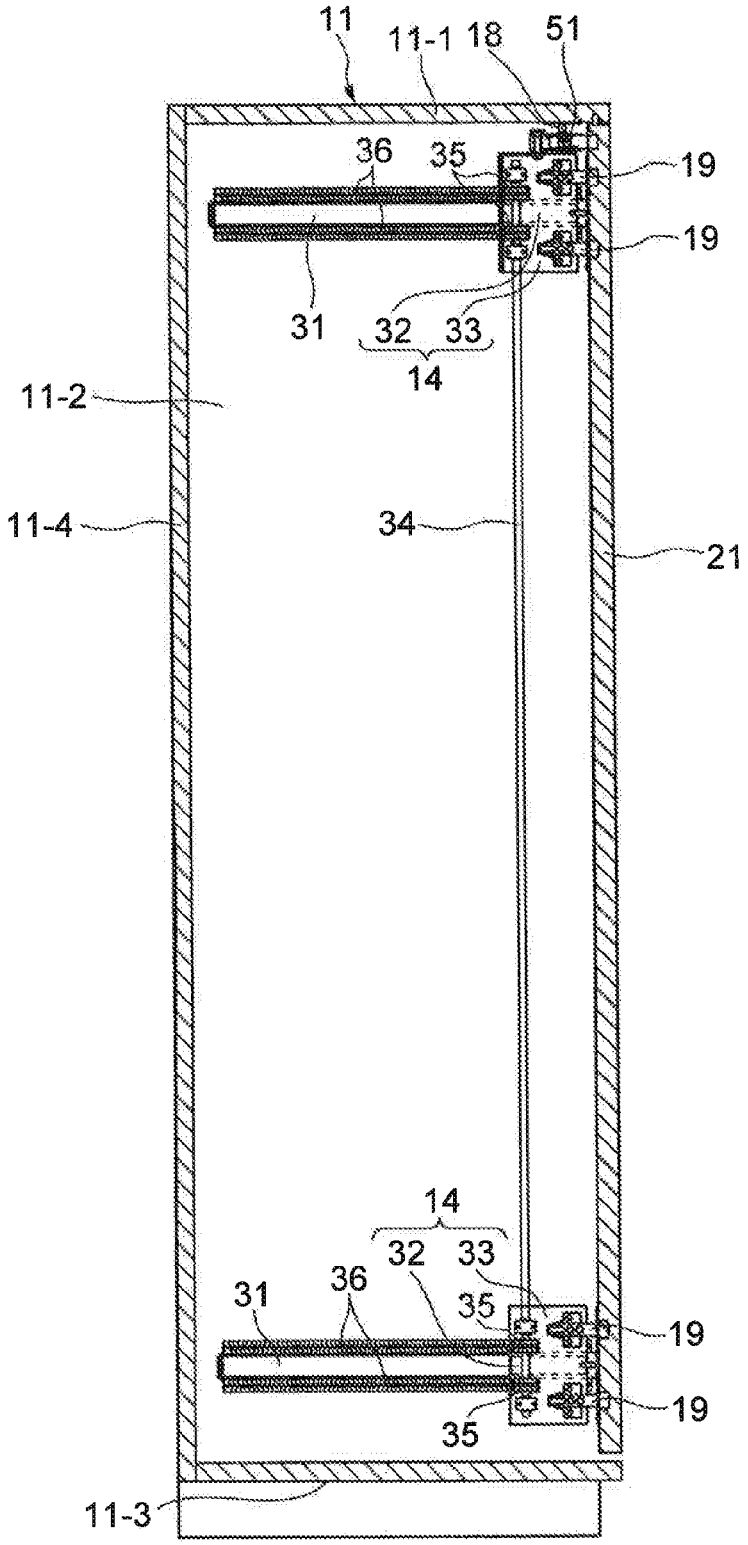
FIG. 2 is a vertical cross-section view of the article of furniture of FIG. 1.

Now, a stowable folding door device according to one embodiment of the present invention will be described in detail with reference to the drawings. FIG. 1 illustrates a front view of the stowable folding door device of this embodiment, FIG. 2 illustrates a vertical cross-sectional view, and FIG. 3 illustrates a horizontal cross-sectional view.

As shown in FIG. 1, a foldable door 12 for opening and closing an opening 11*a* is provided in the front face of an article of furniture 11. The article of furniture 11 is shaped like a box, and has a top plate 11-1, a pair of side plates (right side plate and left side plate) 11-2, a lower plate 11-3, and a rear plate 11-4 (see FIG. 2). The opening 11*a*, which has a rectangular shape elongated in the up and down direction when viewed from the front, is formed in the front face of the article of furniture 11. This opening 11*a* is closed and opened by the foldable door 12.

The foldable door 12 has a first door 21 with a size that is equal to a half of the opening 11*a*, and a second door 22 with a size that is equal to the half of the opening 11*a*. The first door 21 and the second door 22 are coupled with each other by, for example, three hinges 23. Each of the hinges 23 has a piece 23*a* that is attached to the first door 21, another piece 23*b* that is attached to the second door 22, and a connecting shaft 23*c* that rotatably connects the pieces 23*a* and 23*b* to each other (see FIG. 3).

Figure 3:
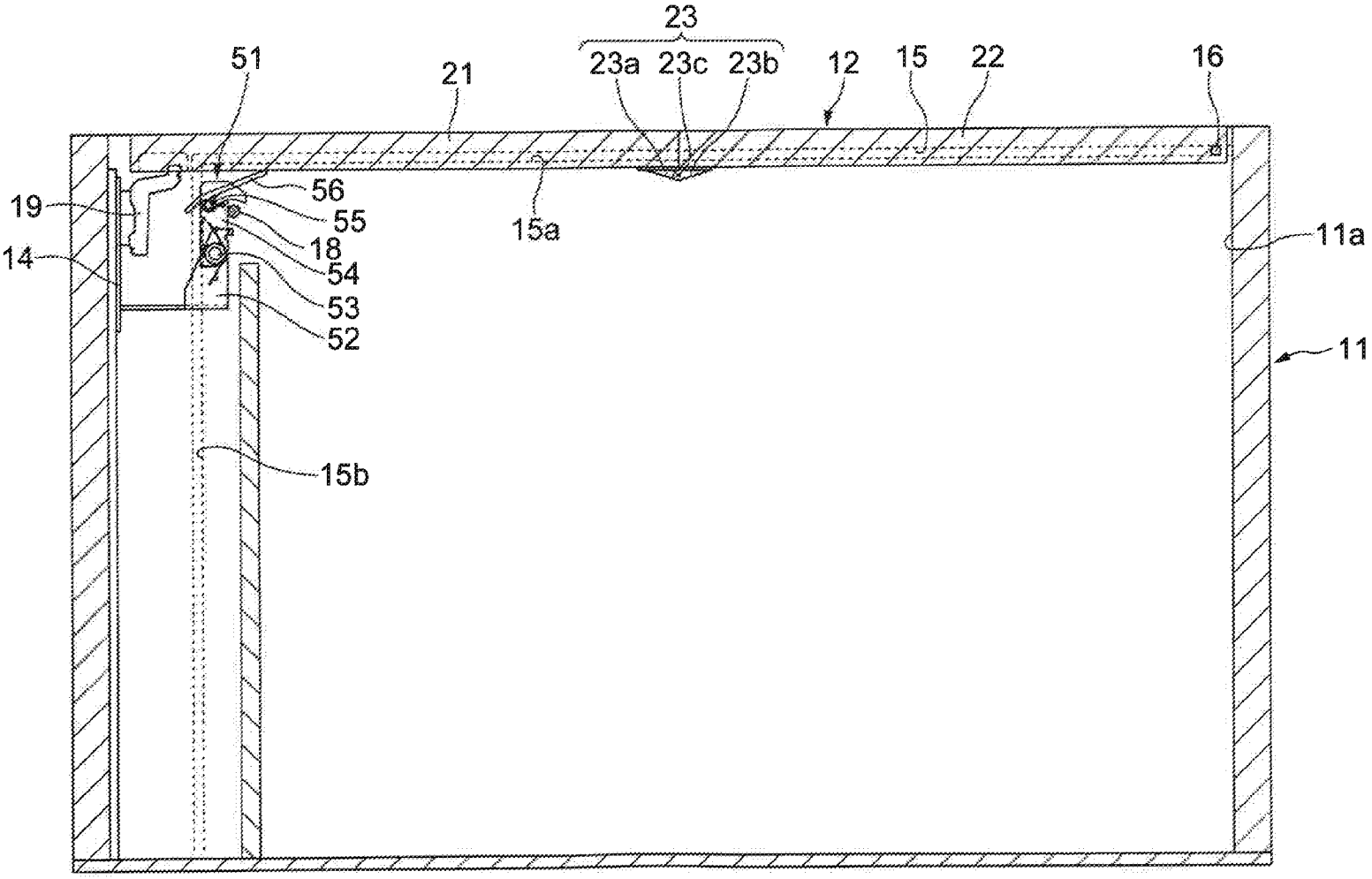
FIG. 3 shows a horizontal cross-section view of the article of furniture of FIG. 1.

As shown in FIG. 3, one end (edge) of the first door 21 is rotatably supported by sliders 14 via the hinges 19. The role of the sliders 14 is to move the folded door 12 in the depth direction of the article of furniture. Each of the hinges 19 may be a slide hinge that opens and closes the first door 21 in a complicated moving route by means of four or more shafts, or a simple hinge that opens and closes the first door 21 in a simple circular moving route using a single shaft. Use of the slide hinges is advantageous because it is possible to stop the opening angle of the first door 21 at a predetermined (desired) angle. A traveling element 16 that travels on an L-shaped guide rail 15 is provided at one end of the second door 22. The second door 22 rotates about the traveling element while running on the guide rail 15.

Firstly, the sliders 14 configured to move the folded door 12 in the depth direction will be described. As shown in FIG. 2, a pair of parallel rails (upper and lower rails) 31 are attached to the side plate 11-2 of the article of furniture 11. Each of the rails 31 is shaped like "U" when viewed in the cross-section, and extends horizontally. A pair of sliders (upper and lower sliders) 14 are mounted on a pair of rails (upper and lower rails) 31 respectively such that the sliders 14 can move horizontally. Each of the sliders 14 has an inner rail 32 received in the associated rail 31 having the U-shaped cross section, and a support plate 33 coupled to the associated inner rail 32 by a bolt (or bolts). Between each rail 31 and the associated inner rail 32, there are provided a plurality of rotatable elements such as balls (not shown) such that the inner rail 32 can move smoothly. Each of the support plates 33 is shaped to, for example, a rectangular plate. Each support plate 33 is equipped with, for example, the above-mentioned pair of hinges (upper and lower hinges) 19. The support plates 33 are connected to each other by a vertical connecting shaft 34 such that the upper and lower sliders 14 move synchronously. The connecting shaft. 34 is rotatably supported by the support plates 33. Pinions 35 are provided at opposite ends of the connecting shaft 34. Each rail 31 has racks 36 extending in parallel to the rail 31 to mesh with the pinions 35. While the upper and lower sliders 14 are moving in the depth direction of the article of furniture 11, the pinions 35 of the connecting shaft 34 move meshing with the racks 36. As a result, the upper and lower sliders (paired sliders) 14 move synchronously. If the connection shaft 34 were not provided, the lower slider 14 would move earlier than the upper slider 14 because of the weight of the foldable door 12, and therefore it would become difficult to move the foldable door 12 smoothly. Providing the connecting shaft 34 solves this problem.

Figure 4:
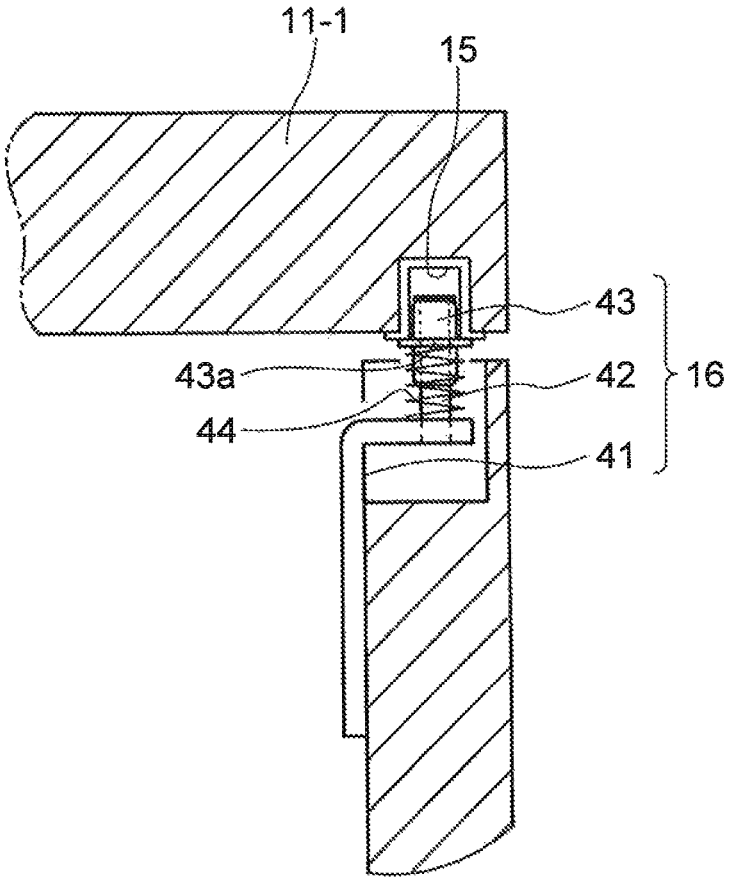
FIG. 4 shows a vertical cross-section view of a guide rail and a traveling element.

The guide rail 15 mounted on the top plate 11-1 of the article of furniture 11 will be described. As indicated by the broken line in FIG. 3, the L-shaped guide rail 15 is provided on the top plate 11-1 of the article of furniture 11, A traveling element 16, which is provided at one end of the second door 22 of the foldable door 12, fits in the guide rail 15. While the foldable door is opening/closing, the traveling element 16 runs on the guide rail 15. The guide rail 15 includes a first guide rail 15*a* which is parallel to the front face of the opening 11*a* of the article of furniture 11, and a second guide rail 15*b* which is perpendicular to the first guide rail 15*a*. As shown in FIG. 4, the cross sectional shape of the guide rail 15 is shaped to "U," and the guide rail 15 is buried in the top plate 11-1. The traveling element 16 includes a bracket 41 attached to the back face of the second door 22, a vertical shaft 42 coupled to the bracket 41, and a resin roller 43 which rotatably fits on the vertical shaft 42. The roller 43 has an outwardly extending flange 43*a* that is integral with the roller 43. A coil spring 44 is provided between the flange 43*a* of the roller 43 and the bracket 41 to bias the flange 43*a* toward the guide rail 15. This makes it possible to position the roller 43 in the guide rail 15.

A lock mechanism 51 for preventing the foldable door 12 from moving in the depth direction prior to the complete folding of the foldable door 12 will be described. As depicted in FIG. 3, the lock mechanism 51 is attached on the slider 14. The lock mechanism 51 includes a bracket 52 that is coupled to the slider 14 by a bolt or the like, a hook 54 supported by the bracket 52 such that the hook 54 can rotate about the first rotation shaft 53, and a lever 56 supported by the hook 54 such that the lever 56 can rotate about the second rotation shaft 55.

A root portion of the bracket 52 is connected to the slider 14 by a bolt or the like. The bracket 52 is bent in the middle thereof to have an L shape, and a plate-like front end portion of the bracket 52 extends in the horizontal plane. By mounting the bracket 52 on the slider 14 with the bolt or the like, it is possible to impart (add) the lock mechanism to the slider 14. This facilitates the assembling work of the lock mechanism 51.

The first rotation shaft 53 is mounted on the bracket 52. The first rotation shaft 53 is directed in the vertical direction. The hook 54 is rotatably coupled to the first rotation shaft 53. The front end of the hook 54 bends like a claw and can engage with the pin 18, which is the engaging element. The pin 18 extends vertically downward from the top plate 11-1 of the article of furniture 11. As the hook 54 engages with the pin 18, the slider 14 is no longer possible to move in the depth direction of the article of furniture 11.

The second rotation shaft 55 is coupled to the hook 54. The lever 56 is rotatably attached to the second rotation shaft 55. The lever 56 is made from a resin material, and can abut on (contact) the first door 21 of the foldable door 12.

Figure 5C:
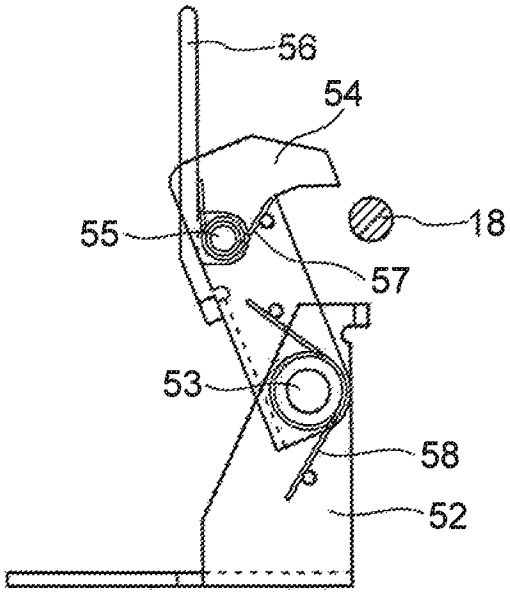
FIG. 5(*a*) illustrates a plan view of a lock mechanism of the stowable folding door device according to the embodiment when the foldable door is in the closed condition, FIG. 5(*b*) illustrates a similar plan view of the lock mechanism before folding the foldable door, and FIG. 5(*c*) illustrates a similar plan view of the lock mechanism when the foldable door is in the completely folded condition.
Figure 5B:
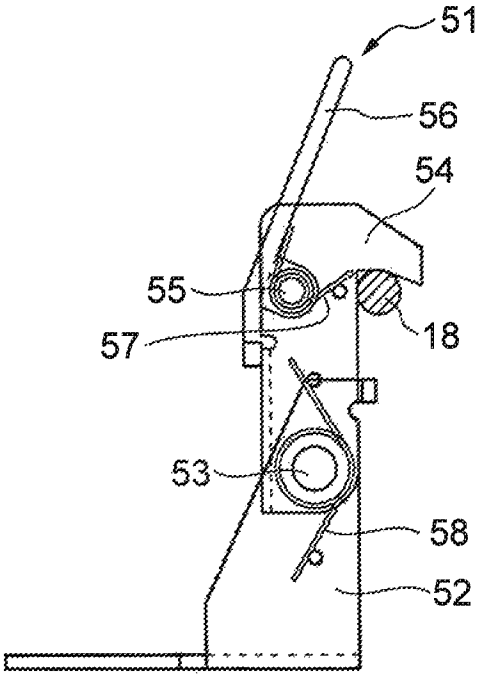
Figure 5A:
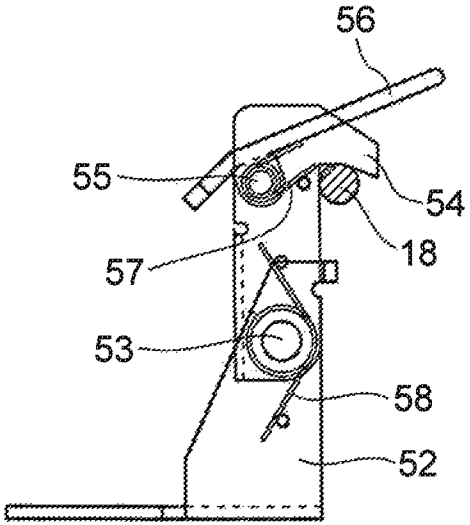

FIG. 5 is a set of plan views to illustrate the movements of the lock mechanism 51. Here, the movement of the lock mechanism 51 alone will be described. The movement of the lock mechanism 51 upon opening and closing of the foldable door 12 will be described later.

FIG. 5(*a*) illustrates the lock mechanism 51 when the foldable door 12 is in the completely closed condition. As understood from FIG. 5(*a*) to FIG. 5(*b*), when the lever 56 rotates to a predetermined angle, relative to the hook 54, in a counterclockwise direction (first direction) about the second rotation shaft 55, the lever 56 abuts on the hook 54 and the lever 56 is no longer rotatable relative to the hook 54. A spring 57 is provided between the lever 56 and the hook 54 to bias the lever 56, which abuts on the hook 54, in the counterclockwise direction. The spring 57 allows the lever 56 to rotate relative to the hook 54 in the clockwise direction (opposite the first direction). For example, a torsion spring may be used as the spring 57.

As understood from FIG. 5(*b*) to FIG. 5(*c*), when the lever 56 is further rotated in the counterclockwise direction, the hook 54 rotates in the counterclockwise direction about the first rotation shaft 53 together with the lever 56. This releases the engagement between the hook 54 and the pin 18. A spring 58 is provided between the hook 54 and the bracket 52 to bias the hook 54, which abuts on the pin 18, in the clockwise direction toward the pin. The spring 58 allows the hook 54 to rotate in the counterclockwise direction. For example, a torsion spring may be used as the spring 58.

As understood from FIG. 5(*b*) to FIG. 5(*a*), when the lever 56 rotates in the clockwise direction (opposite the first direction) in a condition where the hook 54 is engaging with the pin 18, then only the lever 56 rotates relative to the hook 54 in the clockwise direction.

Figure 6:
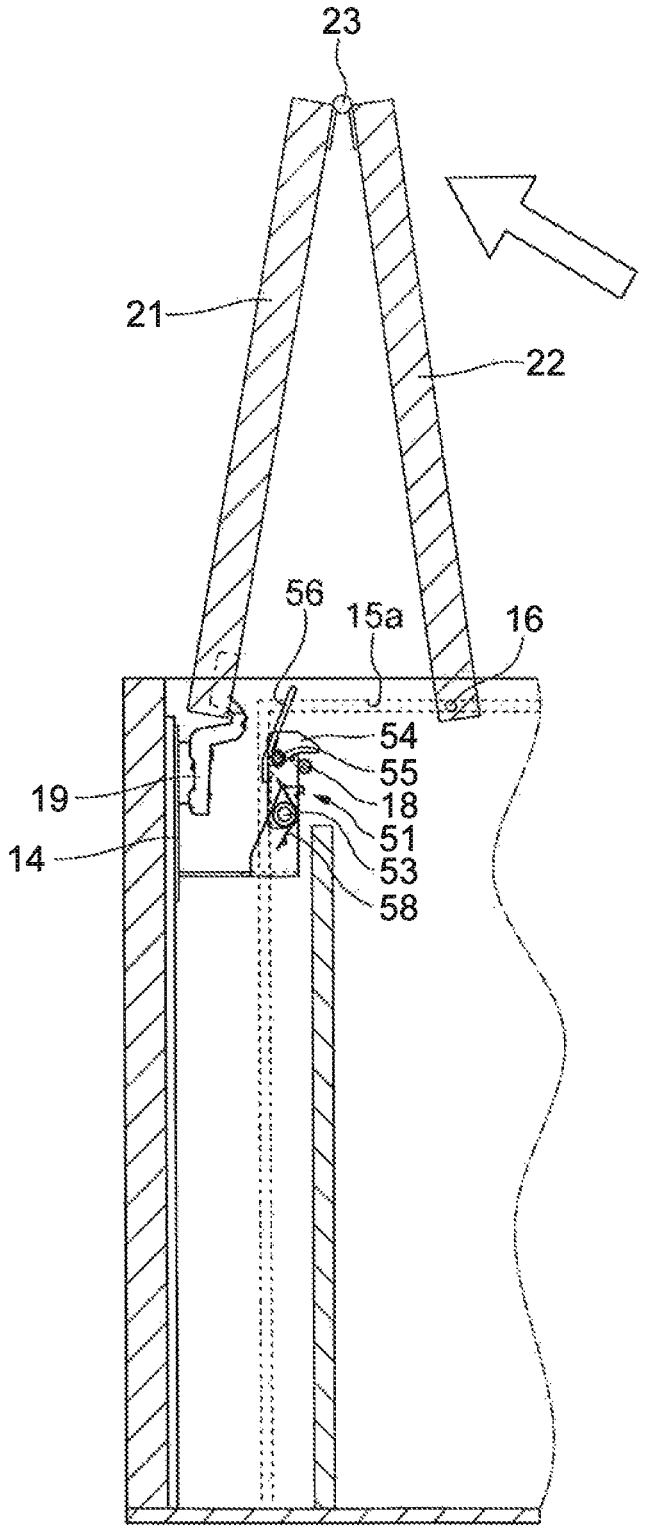
FIG. 6 depicts the movement of the foldable door of the stowable folding door device according to the embodiment of the present invention before the foldable door reaches the folded condition.
Figure 7:
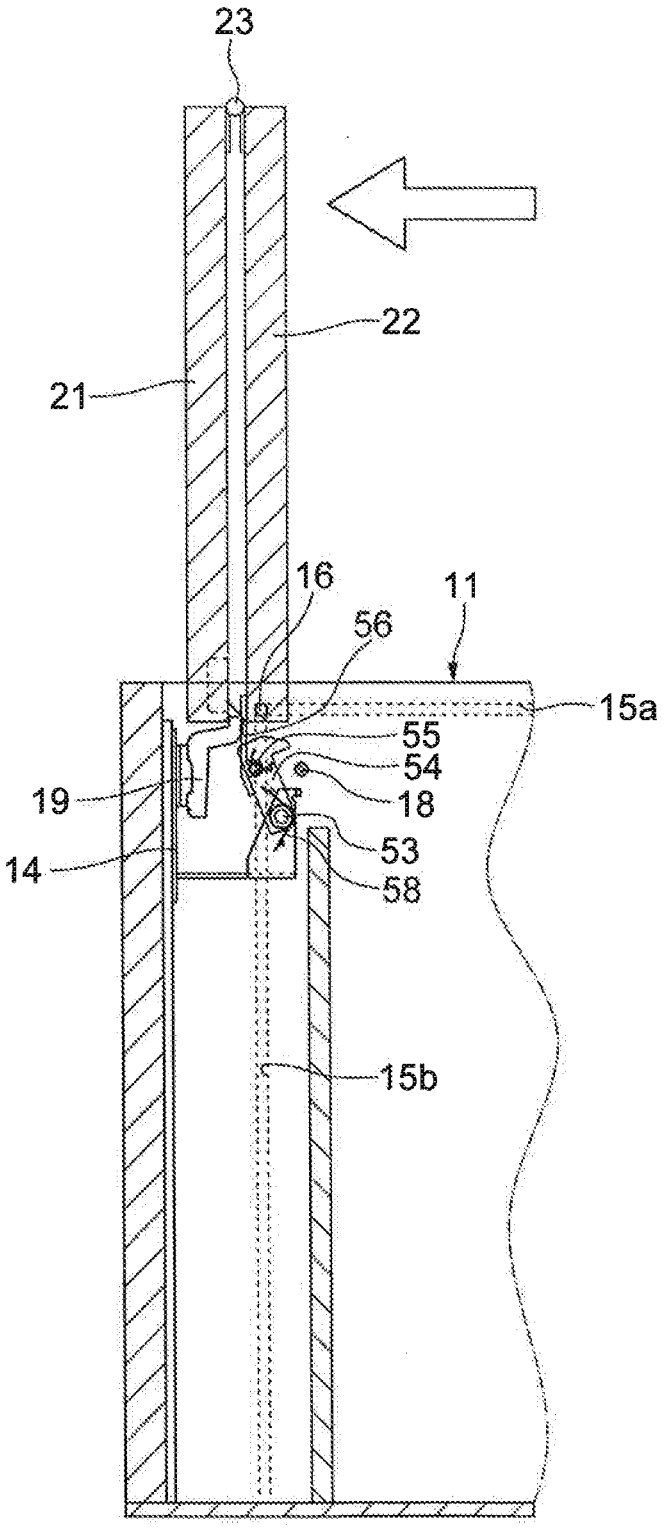
FIG. 7 depicts the movement of the foldable door of the stowable folding door device according to the embodiment when the foldable door is in the completely folded condition.
Figure 8:
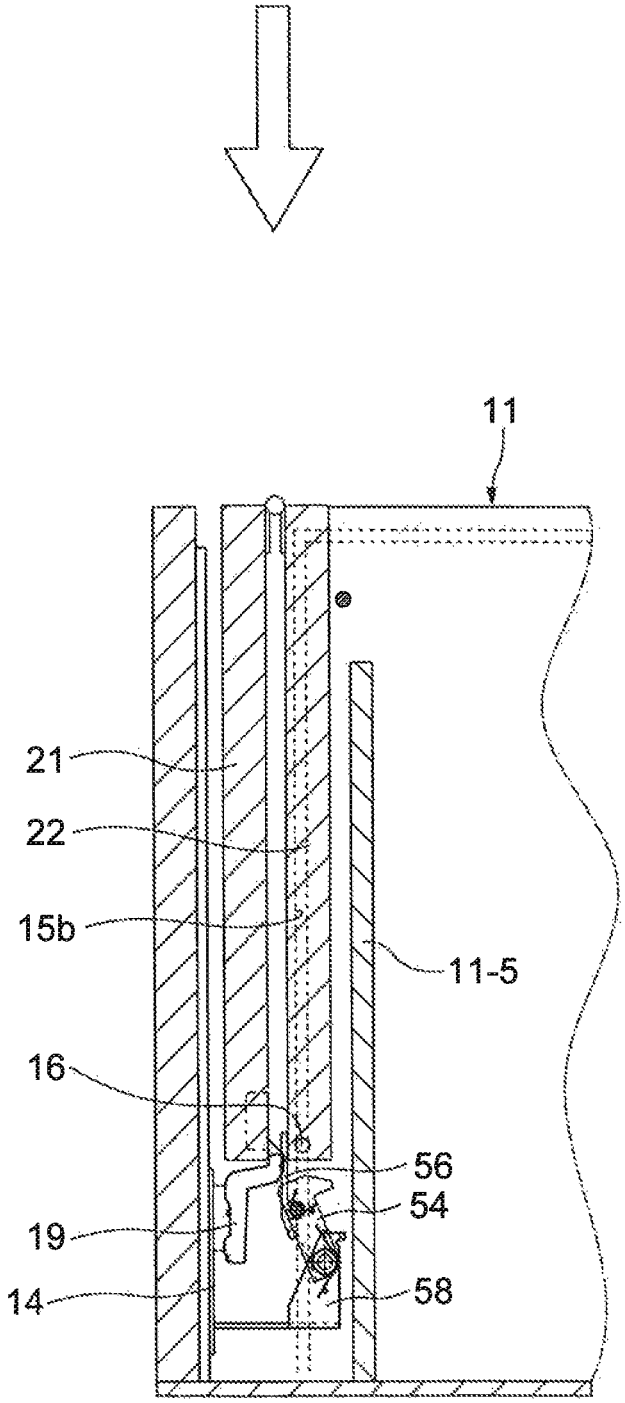
FIG. 8 depicts the movement of the foldable door of the stowable folding door device according to the embodiment when the foldable door is stowed deep in the article of furniture.

Referring now to FIG. 6 to FIG. 8, the movements of the lock mechanism 51 upon closing and opening of the foldable door 12 will be described. The unshaded arrow in each of FIGS. 6 to 8 indicates the direction of the force which an operator applies on the foldable door 12. When the foldable door 12 is folded as shown in FIG. 6, the first door 21 rotates about the hinges 19 attached along one end of the first door 21. The second door 22 rotates about the traveling element 16 provided at one end of the second door 22. As the second door 22 rotates, the traveling element 16 moves along the guide rail 15. As shown in FIG. 6, before the first and second doors 21 and 22 are completely folded up (before the first and second doors 21 and 22 become parallel to each other), the foldable door 12 does not abut on the lever 56 of the lock mechanism 51. Even if the foldable door 12 is forced to move in the depth direction, the hook 54 of the lock mechanism 51 engages with the pin 18 and therefore the slider 14 does not move in the depth direction. Thus, it is possible to prevent the foldable door 12 from being retracted in the article of furniture 11 when the foldable door 12 is at the middle of folding. Before the foldable door 12 reaches the completely folded condition, the lever 56 protrudes forward from the first guide rail 15*a*.

As the foldable door 12 is completely folded (the first and second doors 21 and 22 become parallel to each other) as shown in FIG. 7, the lever 56 rotates about the first rotation shaft 53 in the counterclockwise direction together with the hook 54 while the lever 56 is contacting the back face of the second door 22. This releases the engagement between the hook 54 and the pin 18, and allows the slider 14 to move in the depth direction of the article of furniture 11. At this point in time, the traveling element 16 of the second door 22 is situated at the corner of the guide rail 15.

As illustrated in FIG. 8, when the completely folded door 12 is pushed into the depth direction of the article of furniture 11, the folded door 12 moves in the depth direction of the article of furniture 11 together with the slider 14. While the folded door 12 is moving in the depth direction, the traveling element 16 moves along the second guide rail 15*b*. Because the traveling element 16 travels along the second guide rail 15*b*, the folded door 12 is prevented from opening from the closed condition. The lever 56 is still in contact with the second door 22, and the rotation angles of the hook 54 and the lever 56 relative to the bracket 52 are maintained unchanged. The article of furniture 11 has a wall 11-5 that partitions (defines) the space to receive the folded door 12. The folded door 12 is stowed in this space.

On the contrary, when the door 12 stowed deep in the article of furniture 11 is pulled out, the folded door 12 is pulled out forward in the folded condition, as understood from FIG. 8 to FIG. 7. As depicted in FIG. 7, when the traveling element 16 moves to the corner of the guide rail 15, then the traveling element 16 can move along the first guide rail 15*a*, and it is possible to open the folded door 12. As understood from FIG. 7 to FIG. 6, when the folded door 12 is opened, the lever 56 and the hook 54 are caused to rotate together in the clockwise direction by the biasing force of the spring 58, and the hook 54 engages with the pin 18. Because the spring 58 exerts the biasing force in the direction to open the second door 22, the second door 22 is automatically opened and this facilitates the opening movement of the foldable door 12. As the hook 54 engages with the pin 18, the foldable door 12 does not move in the depth direction.

As shown in FIG. 3, the first and second doors 21 and 22 of the foldable door 12 are completely opened (the first and second doors 21 and 22 extend in the same plane) and the opening 11*a* of the article of furniture 11 is closed by the foldable door 12, then the lever 56 rotates in the clockwise direction while contacting the rear face of the first door 21. Because the lever 56 escapes in a way not to obstruct the moving route of the foldable door 12, the foldable door 12 can close the opening 11*a* of the article of furniture 11.

Figure 9:
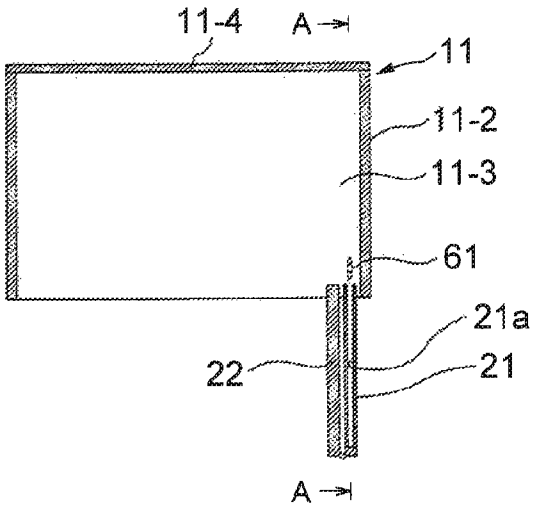
FIGS. 9 (*a*1) and 9(*a*2) show an example that has a guiding projection on a lower plate of a main body of the article of furniture for guiding a first door before the folded door is stowed in the main body of the article of furniture, respectively, and FIGS. 9(*b*1) and 9 (*b*2) show the same example after the folded door is stowed in the main body of the article of furniture, respectively.
Figure 9:
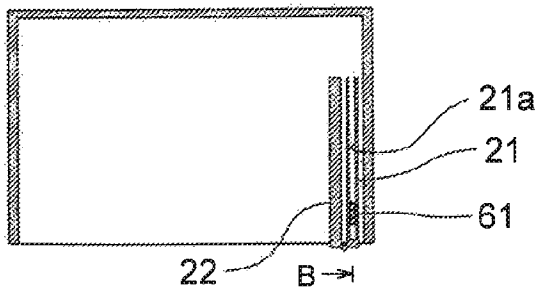
Figure 9:
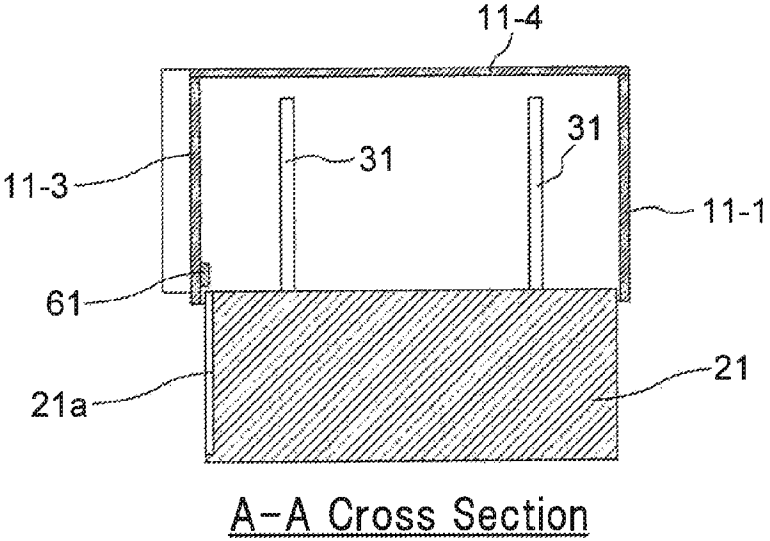
Figure 9:
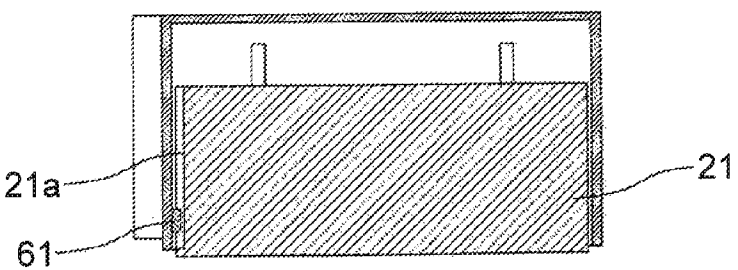

FIG. 9 is a set of views showing an example when a guiding projection 61 configured to guide the foldable door 12 is provided on the lower plate 11-3 of the article of furniture 11. FIG. 9(*a*1) and FIG. 9(*a*2) illustrate the foldable door 12 before stowed deep in the article of furniture 11, and FIG. 9(*b*1) and FIG. 9(*b*2) illustrate the foldable door 12 after stowed in the article of furniture 11. FIG. 9(*al*) and FIG. 9(*b*1) illustrate the horizontal cross-sectional view of the article of furniture 11, and FIG. 9(*a*2) and FIG. 9(*b*2) illustrate the vertical cross-sectional view of the article of furniture 11.

In this example, a groove 21*a* is formed in the bottom face of the first door 21. A guide projection 61 configured to fit in the groove 21*a* is formed on the lower plate 11-3. The guide projection 61 has a boat-like shape, with front and back ends thereof being sharpened. By providing such a guide projection 61, it is possible to move the folded door 12 more stably.

Figure 10:
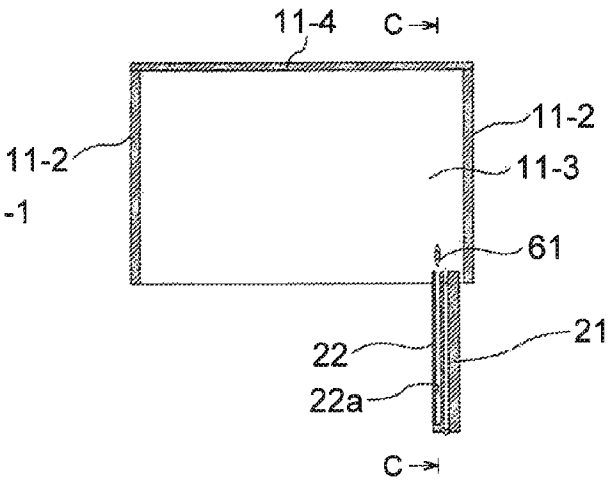
FIGS. 10 (*a*1) and 10 (*a*2) show an example that has a guiding projection on the lower plate of the main body of the article of furniture for guiding a second door before the folded door is stowed in the main body of the article of furniture, respectively, and FIGS. 10 (*b*1) and 10(*b*2) show the same example after the folded door is stowed in the main body of the article of furniture, respectively.
Figure 10:
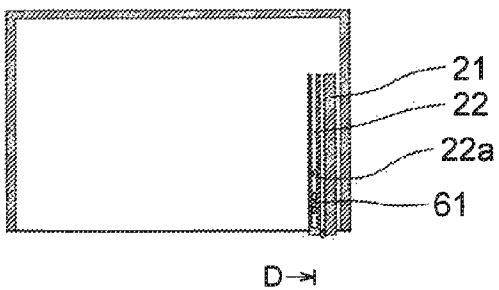
Figure 10:
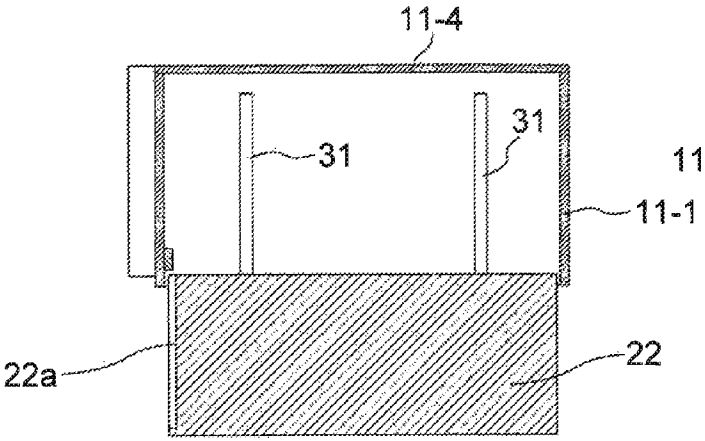
Figure 10:
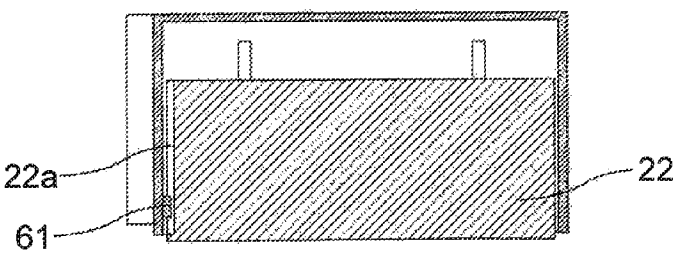
Figure 11A:
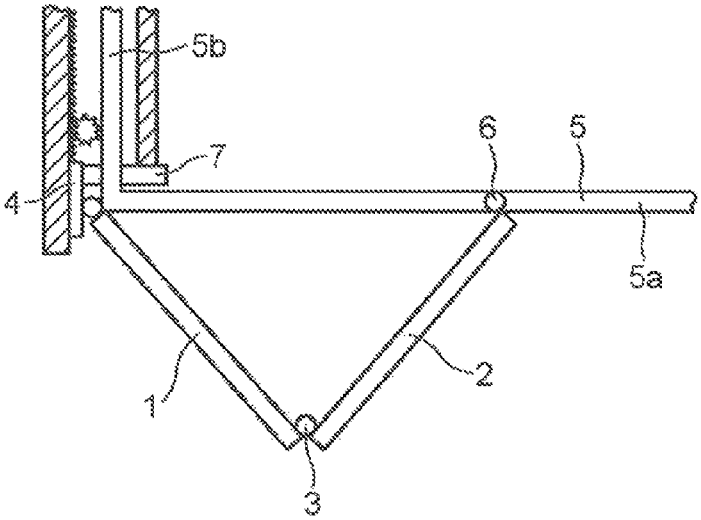
FIG. 11(a) Prior Art
FIG. 11 (*a*) shows a horizontal cross-sectional view of a conventional stowable folding door device before the foldable door is folded, and FIG. 11 (*b*) shows a similar cross-sectional view when the foldable door is completely folded.
Figure 11B:
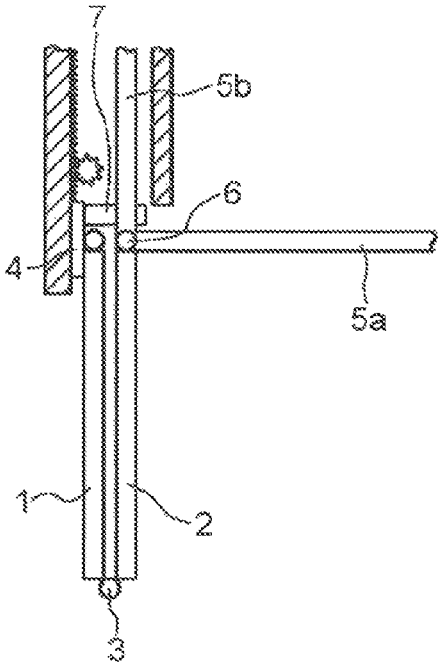
FIG. 11(b) Prior Art

FIG. 10 is a set of views illustrating another example that has a guide projection on the lower plate 11-3 of the article of furniture 11 to guide the foldable door 12. This example is different from the example of FIG. 9 in that a groove is formed in the bottom face of the second door 22, and the guide projection 61 is received in the second door 22. Because other structures of this example are the same as the example of FIG. 9, the same reference numerals are allotted to such structures, and the description for such structures is omitted.

It should be noted that the present invention is not limited to the above-described embodiment, and other embodiments and various modifications may be made without departing from the spirit and scope of the present invention.

For example, although the spring is used to maintain the contact of the lever with the hook in the above-described embodiment, a magnet catch, a roller catch or a friction force may be used instead of the spring to maintain the contact of the lever with the hook. Any case is satisfactory as long as the lever rotates in one direction (first direction) together with the hook upon folding the foldable door, and only the lever rotates relative to the hook in a direction opposite the first direction upon closing the opening with the foldable door.

It should also be noted that those parts of the first and second doors which contact the lever may be covered with metallic plates in order to prevent the wear (abrasion) of the first and second doors which contact the lever.

Although the opening of the article of furniture is opened and closed by the foldable door having a pair of doors (two doors) in the above-described embodiment, the opening of the article of furniture may be opened and closed by a pair of foldable doors (four doors), with one of the foldable doors being provided at one end of the opening and the other being provided at the opposite end of the opening.

Although the lower plate is attached to the main body of the article of furniture in the above-described embodiment, the lower plate may be dispensed with if heavy items are expected to be put in the article of furniture.

Application of the present invention is not limited to the article of furniture, and the present invention may be applied to a partition member or unit (e.g., partition unit that divides rooms in a building, and a partition member that separates the building, such as the entrance, from the outside).

This application is based on Japanese Patent Application No. 2012-018907 filed on Jan. 31, 2012, and the entire disclosure thereof is incorporated herein by reference.

REFERENCE NUMERALS

11 Article of furniture
11-3 Lower plate of the article of furniture
11*a* Opening of the article of furniture
12 Foldable door
14 Slider
18 Pin (engaging element)
21 First door
21*a* Groove
22 Second door
51 Lock mechanism
52 Bracket
53 First rotation shaft
54 Hook
55 Second rotation shaft
56 Lever
61 Guiding protection

What is claimed is:

1. A stowable folding door device configured to guide opening and closing movements of a foldable door having first and second doors capable of folding and to cause the folded door to move in a depth direction of an article of furniture or a partition member, the stowable folding door device comprising:

a slider with a hinge, the slider being configured to rotatably support the first door on the hinge and configured to move the folded door in the depth direction of the article of furniture or the partition member;

a hook rotatably supported by the slider such that the hook can rotate about a first rotation shaft and engage with an engaging element provided at the article of furniture or the partition member; and a lever rotatably supported by the hook such that the lever can rotate about a second rotation shaft, the lever being configured to rotate about the first rotation shaft in a first direction together with the hook, the lever being configured to directly contact a rear face of the second door of the foldable door upon folding the foldable door, thereby disengaging the hook and the engaging element from each other, and allowing the slider to move in the depth direction of the article of furniture or the partition member, and the lever being further configured to rotate relative to the hook about the second rotation shaft in a direction opposite the first direction, the lever being configured to directly contact a rear face of the first door of the foldable door upon closing an opening of the article of furniture or the partition member with the foldable door.

2. The stowable folding door device according to claim 1 further comprising a spring provided between the hook and the lever and configured to bias the lever, which is in contact with the hook, in the first direction, and to allow the lever to rotate relative to the hook in the direction opposite the first direction.

3. The stowable folding door device according to claim 1 further comprising a guide projection provided on a lower plate of the article of furniture or the partition member and configured to fit in a groove formed in a bottom face of the foldable door and guide the folded door that moves in the depth direction of the article of furniture.

4. The stowable folding door device according to claim 2 further comprising a guide projection provided on a lower plate of the article of furniture or the partition member and configured to fit in a groove formed in a bottom face of the foldable door and guide the folded door that moves in the depth direction of the article of furniture.

* * * * *